United States Patent [19]

Hancherick

[11] 4,249,737

[45] Feb. 10, 1981

[54] AMUSEMENT DEVICE

[75] Inventor: Kenneth J. Hancherick, Las Vegas, Nev.

[73] Assignee: Concorde Manufacturing Company, Las Vegas, Nev.

[21] Appl. No.: 38,618

[22] Filed: May 14, 1979

[51] Int. Cl.[3] ..... A63F 5/04

[52] U.S. Cl. ..... 273/143 R

[58] Field of Search ..... 273/143 R, 143 A, 143 B, 273/143 C, 143 D, 143 E

[56] References Cited

U.S. PATENT DOCUMENTS

| | | | |
|---|---|---|---|
| 2,044,320 | 6/1936 | Norris | 273/143 R |
| 2,087,709 | 7/1937 | Van Guilder | 273/143 R |
| 2,180,029 | 11/1939 | Babcock | 273/143 E |
| 3,759,525 | 9/1973 | Davis | 273/143 R |
| 3,810,628 | 5/1974 | Vigan | 273/143 R X |
| 4,097,048 | 6/1978 | Poulsen et al. | 273/143 R |

FOREIGN PATENT DOCUMENTS

| | | | |
|---|---|---|---|
| 1200172 | 7/1970 | United Kingdom | 273/143 R |
| 1238486 | 7/1971 | United Kingdom | 273/143 R |
| 1368622 | 10/1974 | United Kingdom | 273/143 R |
| 1382379 | 1/1975 | United Kingdom | 273/143 R |

*Primary Examiner*—Richard C. Pinkham
*Assistant Examiner*—Arnold W. Kramer

[57] ABSTRACT

The disclosure refers generally to amusement devices of the rotating wheel type which employ a plurality of rotatable wheels having indicia thereon which are rotated by the player and are arrested at random. When certain random combinations of indicia are aligned after the wheels are arrested, a win condition is sensed and the player receives a reward. The disclosure is particularly concerned with improvements in the mechanisms for rotating the wheels and for arresting wheel rotation.

15 Claims, 9 Drawing Figures

210
25
200
220
218
72
70
126
124
74
76
78
90
122
58
120
92
160
54
77
25
164
76
140
52
112
79
141
40
114
108
56
82
64
132
60
51
50
19
130
62
20
20
19

AMUSEMENT DEVICE

BACKGROUND OF THE INVENTION

The present invention relates generally to amusement devices of the type having a plurality of indicia bearing wheels which are mechanically rotated by the player and which, when appropriate combinations of indicia are aligned after the wheels cease rotation, provide a reward or payout.

DESCRIPTION OF PRIOR ART

Typical prior art devices are mechanically actuated through the use of a handle or lever which actuates a trip mechanism to impart rotation to the various wheels and electronic circuitry in the device is employed to arrest rotation of the various wheels at random and then to sense the angular position of the wheels to determine whether a payout combination has been reached.

There are known prior art devices which, instead of using a mechanically actuated trip mechanism to impart rotation to the wheels, use electrical motor actuation techniques whereby the operator pulls a handle which in turn causes a motor to impart rotation to the wheels. Such devices have proven generally unsatisfactory and have not gained widespread acceptance due to the fact that the operators of such devices prefer mechanical actuation through the use of a handle which provides a certain amount of feel and presumed control over the device.

U.S. Pat. No. 3,642,287, Lalley et al pertains to a rotating reel game and discloses a conventional type of reel spinning mechanism employing the usual pivoted handle or lever which, upon release of some form of a master control and lockout means, is moveable to impart rotation to the various reels. Each reel has a slotted selector disc affixed thereto having variable depth selector slots engaged by a spinning lever to mechanically impart rotation to the reels. The depth of the selector slots is used for the purpose of indicating the location of indicia or symbols on the reels. A relatively complex system of pivoted levers is employed by the patentee to cause the desired reel rotation. A pivotally mounted trip-out cam couples a reel cocking lever with an associated trip lever during a predetermined degree of angular rotation after which time the trip-out cam engages an adjustable position stop mounted on the mechanism housing to pivot the cam and uncouple the cocking lever from the trip lever. The exact position of the stop determines the rotary position at which uncoupling takes place.

Known handle-actuated gaming devices have frequently been subject to considerable maintenance due to the high number of moving parts in the reel actuation and reel arrest mechanism and it is accordingly an objection of the present invention to reduce the number of moving parts in such mechanism and thus increase the reliability and minimize maintenance and repair time required for such devices.

A further problem existing in the prior art is the fact that the wheel speed arresting mechanisms are not entirely fault-free and such devices can be subject to mechanical manipulation by skilled users to increase the percentage of payout. Additionally, in some prior art devices the rotating wheels, shortly before motion is completely arrested, are subject to a "bouncing" condition which should be entirely eliminated. It is an objective of the present invention to overcome these disadvantages of the prior art.

SUMMARY OF THE INVENTION

The present invention provides, in an amusement device having a housing, a plurality of rotatable wheels having indicia thereon, means for imparting rotation to said wheels, means for arresting rotation of said wheels and means for sensing the arrested position of said wheels, the improvement wherein said means for imparting rotation to said wheels comprises:

- a substantially horizontal drive shaft;
- a clutch rotatable through a drive stroke less than 180° mounted in a substantially vertical plane for free rotation on said drive shaft;
- a crank drive pawl pivotally mounted on said clutch at a pivot location spaced from the center of rotation of said clutch; and
- an operating crank non-rotatably affixed to said drive shaft, said operating crank having a drive notch for engagement with said pawl, said clutch being rotatable through a predetermined angle following which said pawl is biased into engagement with said drive notch, said clutch and operating crank thereafter rotating together through a drive portion of the drive stroke.

The present invention provides, in an amusement device having a housing, a plurality of rotatable wheels, having indicia thereon, means for imparting rotation to said wheels, means for arresting rotation of said wheels, and means for sensing the arrested portion of said wheels, the improvement wherein the means for arresting rotation of said wheels comprises:

- a substantially horizontal drive shaft mounted in said housing;
- a substantially horizontal support shaft mounted in said housing parallel with said drive shaft;
- a plurality of index arms freely mounted for pivotal movement on said support shaft, one index arm for each wheel, said index arms each having stop means thereon for arresting rotation of an associated wheel;
- springs for biasing said index means toward said wheels, each wheel having a latch disc rigidly affixed thereto, said wheels and latch discs being rotatable in parallel planes on a common shaft, said latch discs having notches thereon engageable by said stop means on said index means;
- a plurality of actuation levers freely rotatable on said support shaft;
- a plurality of solenoids each having a moveable member engageable with a respective actuation lever; and
- a plurality of index arm latch assemblies rigidly affixed to said drive shaft and rotatable therewith, for moving said index arms out of engagement with said notches in said latch discs and holding said index arms in said non-engaged positions, said latch assemblies being engageable by said actuation levers for releasing said index arms upon actuation of said solenoids.

BRIEF DESCRIPTION OF DRAWINGS

The invention will now be described in detail following the general description of the drawings in which.

DESCRIPTION OF THE PREFERRED EMBODIMENT

Figure 1:
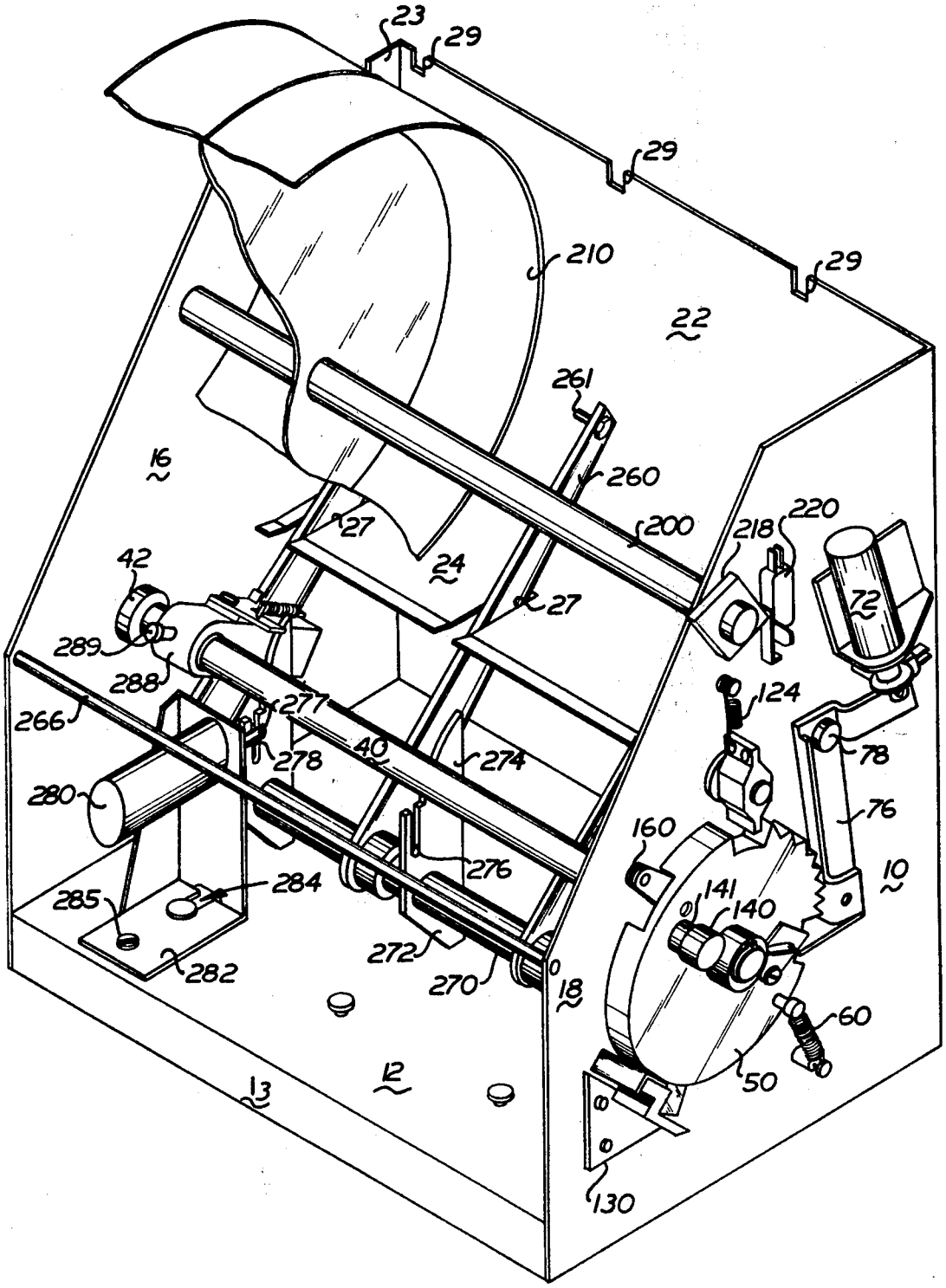
FIG. 1 is a perspective view, partially broken away, showing the elements of the present invention mounted in a sheet metal housing or frame.
Figure 7:
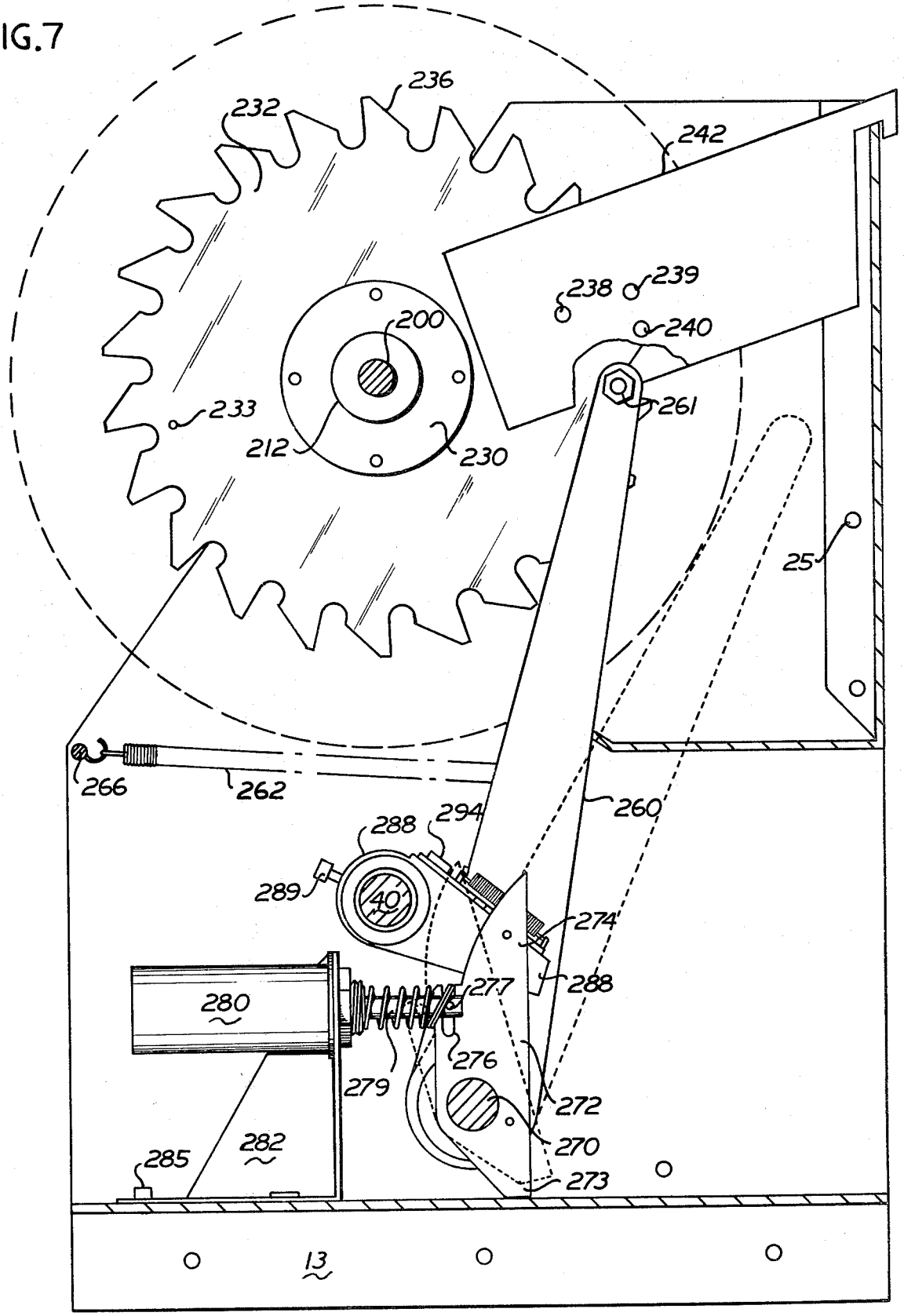
FIG. 7 is an elevational view, partly in section, taken along lines 7—7 of FIG. 8.

Referring first of all to FIG. 1 it will be seen that the housing or frame 10 preferably comprises a sheet metal structure having a flat rectangular bottom 12 formed of a piece of sheet metal with each of the four sides 13 turned downwardly. The left side 16 and right side 18 of the frame 10 each comprise generally rectangular sheet metal members having a forward corner cutoff as shown to provide a generally forwardly sloping front face. The left side member 16 and right side member 18 are affixed by suitable means such as screws 20 or welding to the down turned sides 13 of the bottom frame member 12. The back frame member 22 comprises a generally rectangular sheet metal piece which extends downwardly approximately half way from the top of the side frame members to a generally horizontal shelf 24. Each side 23 of the back frame member 22 is turned inwardly as shown for affixation to the left side and right side frame members 16, 18 by suitable means such as welding or screws 25. It will be noted that there are a plurality, preferably three or four horizontal slots 27 in the shelf at equally spaced locations for purposes which will appear later. Along the top of the back frame member are three cutouts 29 for engagement with respective photocell mounting brackets as seen in FIG. 7.

A drive shaft 40 extends horizontally and is journaled in bearings 42 affixed to the left side frame member 16 and the right side frame member 18. Freely mounted on the right-hand end of the drive shaft is an operating clutch 50 secured to the end of the shaft 40 by a suitable resilient snap spring 52. The operating clutch 50 comprises a generally circular member having a plurality of teeth 54 on the periphery extending for an angular distance of from 40° to 50° and preferably about 45°. At either end of the toothed section are respective notches 56, 58 in the periphery of the operating clutch 50. The first notch 56 is generally in horizontal alignment with the drive shaft 40. A clutch bias tension spring 60 extends from an anchor post 62 rigidly affixed to the right-hand frame member to a similar anchor post 64 rigidly affixed to the operating clutch 50.

A solenoid mounting bracket 70 affixed to the right side frame member mounts a solenoid 72 having a spring biased plunger 74 engageable with one arm 77 of a bell crank pivotally mounted by a pivot 78 to the frame. A second arm 79 of the bell crank 76 has a tongue 82 rigidly affixed thereto which is biased into the first notch 56 in the operating clutch 50 by a spring 76 on the solenoid plunger 74. A small switch 90 is mounted in proximity to the solenoid plunger 74 and has a trigger tongue 92 moveable with the solenoid plunger 74 to provide an electrical output whenever the solenoid 72 is actuated. In operation, a coin deposited into the machine causes an electrical pulse to actuate the solenoid 72 thus withdrawing the solenoid plunger 74 and pivoting the bell crank 76 in a counterclockwise direction to remove the bell crank tongue 82 from the notch 56 in the operating clutch 50.

Figure 2:
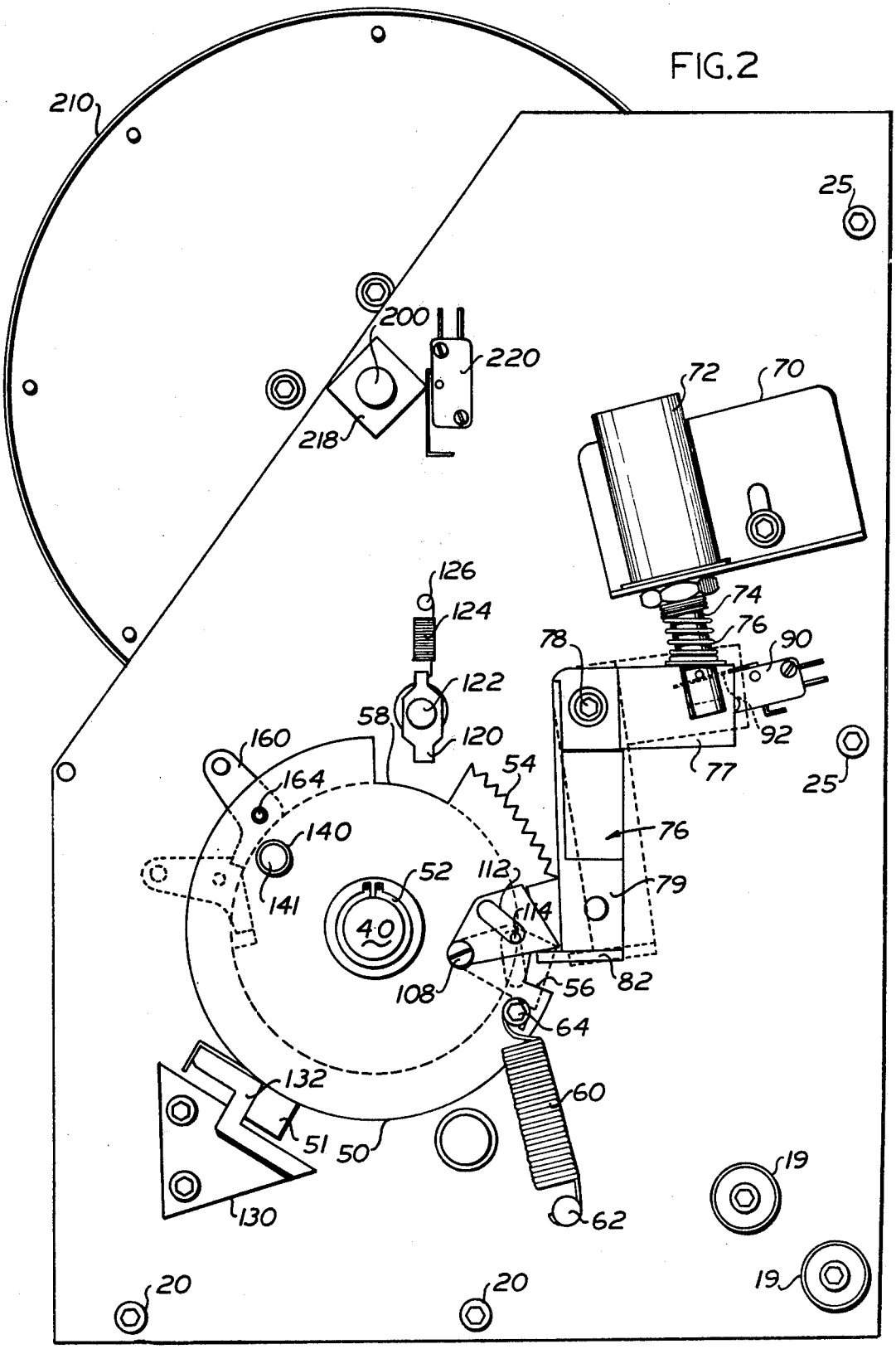
FIG. 2 comprises a right-hand elevation.

A pivot pin 108 on the operating clutch 50 mounts a clutch latch release dog 110 (FIG. 3) which gravitationally moves to the dashed line position in FIG. 2 whenever the tongue 82 of the bell crank 76 has been removed from the notch 56. An elongated slot 112 in the release dog 110 is engageable with a pin 114 mounted in the operating clutch 50 to limit gravitational movement of the latch release dog 110.

At the other end of the toothed peripheral section of the operating clutch 50 is a second notch 58 which provides a clearance space for a clutch stop ratchet 120 mounted on a pivot pin 122 rigidly affixed to the right side frame member 18 as shown in FIG. 2. A tension spring 124 connects one arm of the clutch stop ratchet 120 with an anchor pin 126 affixed to the frame member 18.

A clutch abutment stop 130 is rigidly affixed to the frame member 18 and has a resilient pad 132 thereon engageable with a clutch abutment 51 which is rigidly affixed to the operating clutch 50. The clutch bias spring 60 ordinarily biases the clutch 50 to a rotary position such that the clutch abutment 51 is in firm engagement with the abutment stop 130.

An actuation roller 140 mounted on a stud 141 affixed to the operating clutch at the location shown is the mechanism by which a handle (not shown) pivotally mounted on the device is employed to impart counterclockwise motion (as seen in FIG. 2) to the operating clutch 50.

Figure 3:
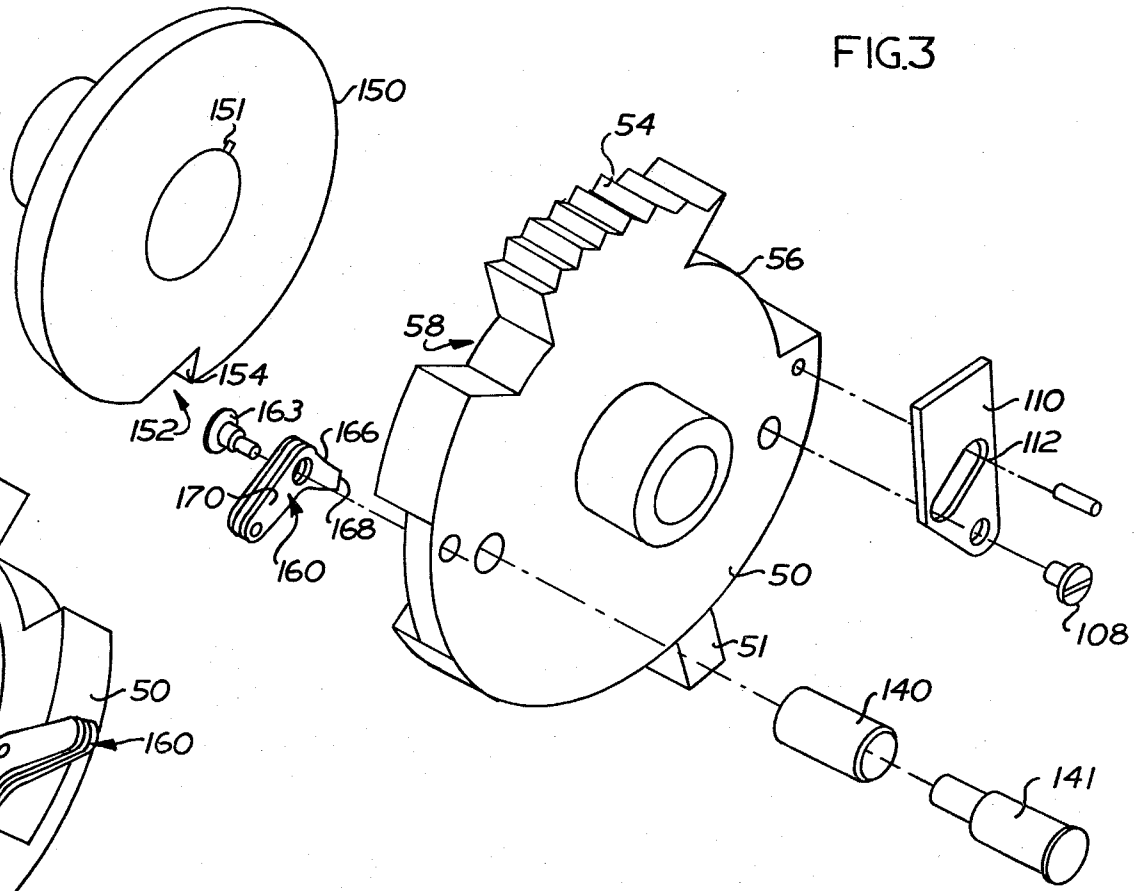
FIG. 3 comprises an exploded view of the operating clutch assembly seen in FIG. 2.

As best seen in FIGS. 2 and 3, the operating clutch 50 together with an operating crank 150 impart rotation to the drive shaft 40 in a counterclockwise direction. A lost motion connection between the operating clutch 50 and operating crank 150 is provided to permit partial rotation of the operating clutch 50 through an angle of approximately 30° before the operating crank 150 is caused to move.

Figure 3A:
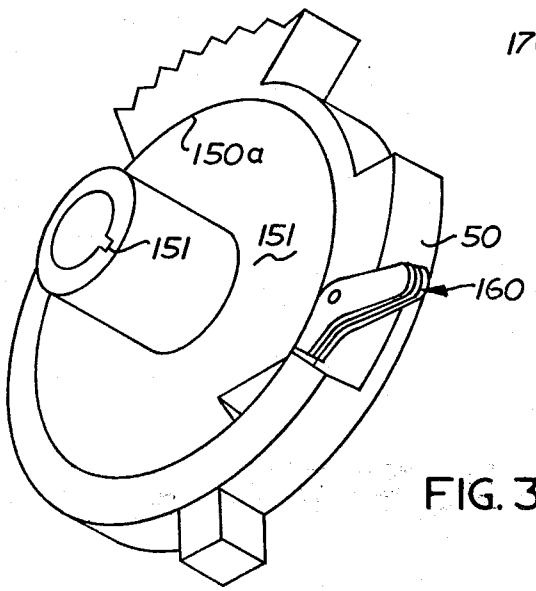
FIG. 3*a* is a perspective view of the opposite side of the assembled operating clutch and operating crank from that seen in FIG. 3.

The operating crank 150 is a generally disc shaped member which is nonrotatably affixed to the drive shaft by a suitable key 151 (FIG. 3*a*). The operating crank 150 is of a smaller diameter than the operating clutch 50 and fits into an annular recess **150*a* in the operating clutch 50 in a close but freely running fit. The operating crank 150 has a peripheral notch 152 which provides a drive shoulder 154** along one edge thereof.

The drive means for imparting rotation from the operating clutch 50 to the operating crank 150 comprises a clutch trip pawl 160 which is loosely mounted for pivotal movement on a pivot sleeve 162 carried by a connecting pin 163, 164 affixed to the operating clutch 50.

The clutch trip pawl 160 comprises an angular member having a preferably curved surface 166 which rests against the annular periphery of the operating crank 150 until such time as the operating clutch 50 has rotated counterclockwise through an angle of approximately 30° at which time a drive arm 168 of the pawl enters the drive notch 152 in the operating crank 150. This is caused by gravity acting on another arm 170 of panel 160.

Figure 4:
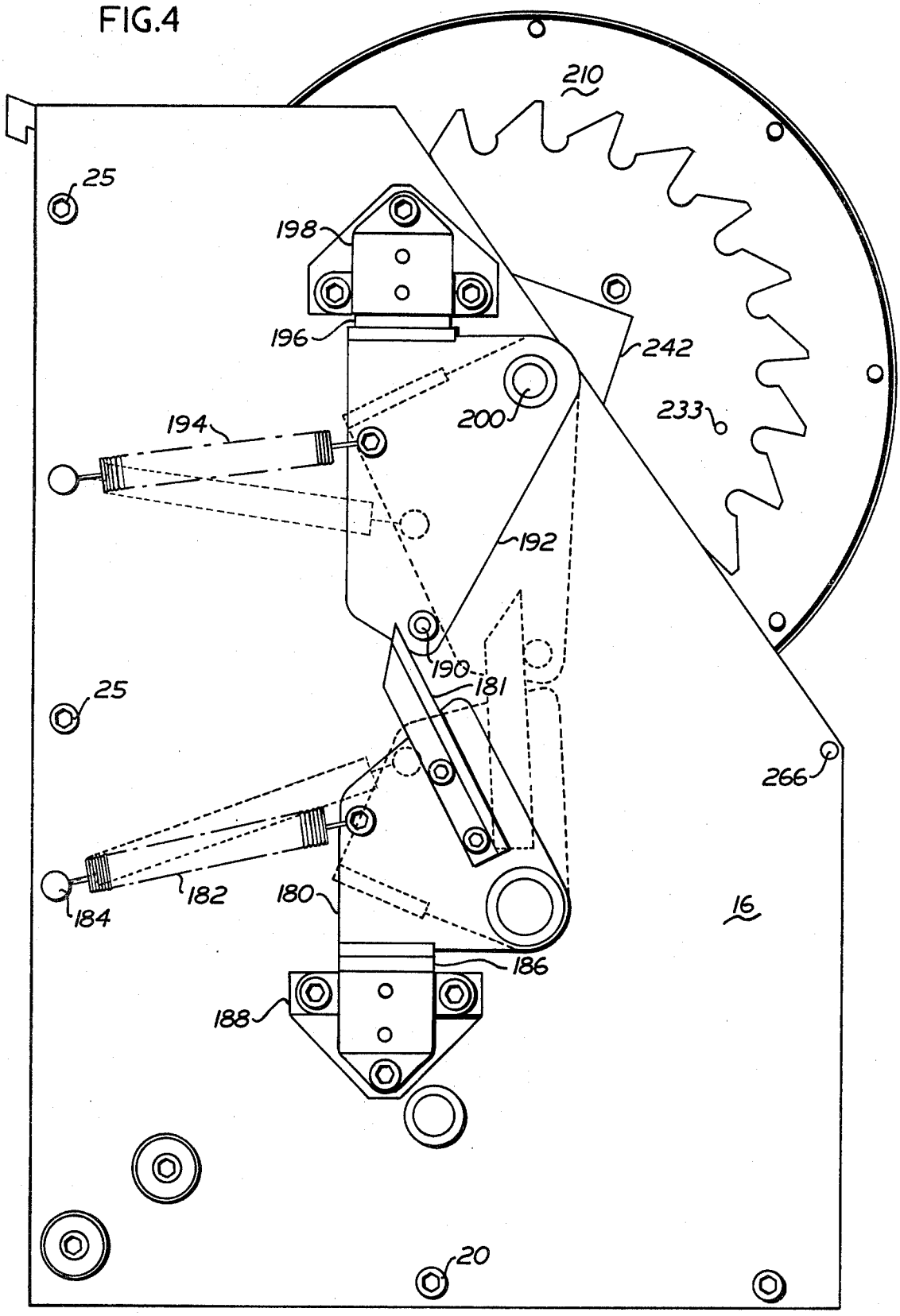
FIG. 4 is an elevational view of the left-hand side of the device.

As can also be seen in FIG. 2 and at a corresponding location in FIG. 4, a pair of rotatable rollers 19 are mounted on the side frame members 16, 18 which rollers ride on a horizontal track (not shown) to assist placement and removal of the mechanism in an exterior housing.

As seen in FIG. 4 an actuation arm bracket 180 is rigidly affixed to the left-hand end of the drive shaft 40 and rotates therewith clockwise (FIG. 4) through an angle of approximately 30° from the solid line position shown to the dashed line position shown near the end of the drive stroke. A bias spring 182 is affixed to the actuation arm bracket 180 and to an anchor post 184 affixed to the frame member 16 to bias the actuation arm bracket 180 counterclockwise against the resilient pad 186 of an abutment stop 188 rigidly affixed to the frame member 16. An elongated actuation arm 181 is affixed to the actuation arm bracket 180 and is located to engage a rigid pin 190 affixed to a bell crank 192 pivotally mounted about a second shaft 200 extending parallel with the drive shaft 40 between the two sides 16, 18 of the frame 10. A tension spring 194 biases the bell crank 192 in the clockwise direction against the rubber pad 196 of a second abutment stop 198 rigidly affixed to the frame member 16.

Figure 5:
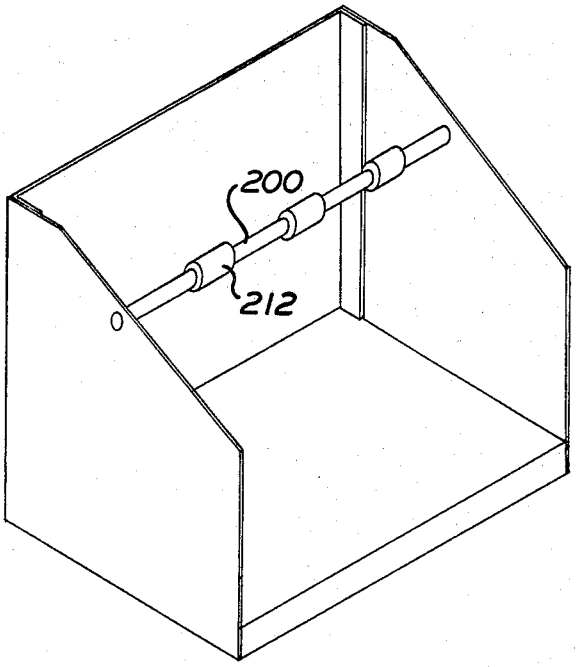
FIG. 5 is a partial perspective view showing one way clutches associated with each of the wheels.

Turning again to FIG. 1 it will be seen that a plurality of wheels or drums 210 are mounted for free rotation on the second shaft 200. Only one drum 210 is shown in FIG. 1 for clarity but it will be appreciated by persons skilled in the art that there are usually three and sometimes more rotatable drums each mounted on the second shaft 200 by means of one-way clutches 212 (FIG. 5) of conventional construction. A sleeve element of each clutch is rigidly fastened to each wheel 210. Rotation of shaft 200 is imparted to the drums 210 by sleeves of clutches 212 which rotate together with shaft 200 in the counterclockwise direction as seen in FIGS. 1 and 2 but which automatically disconnect from shaft 200 whenever wheels 210 and attached sleeves of clutches 212 rotate counterclockwise faster than shaft 200. An example of a one-way clutch suitable for use herein in TORRINGTON MODEL RCB061014.

Rigidly affixed to the right-hand end of the second shaft 200 is a rectangular switch actuator 218 which rotates with the second shaft 200 and actuates a switch 220 mounted on the right-hand frame member everytime the second shaft 200 is rotated.

Figure 8:
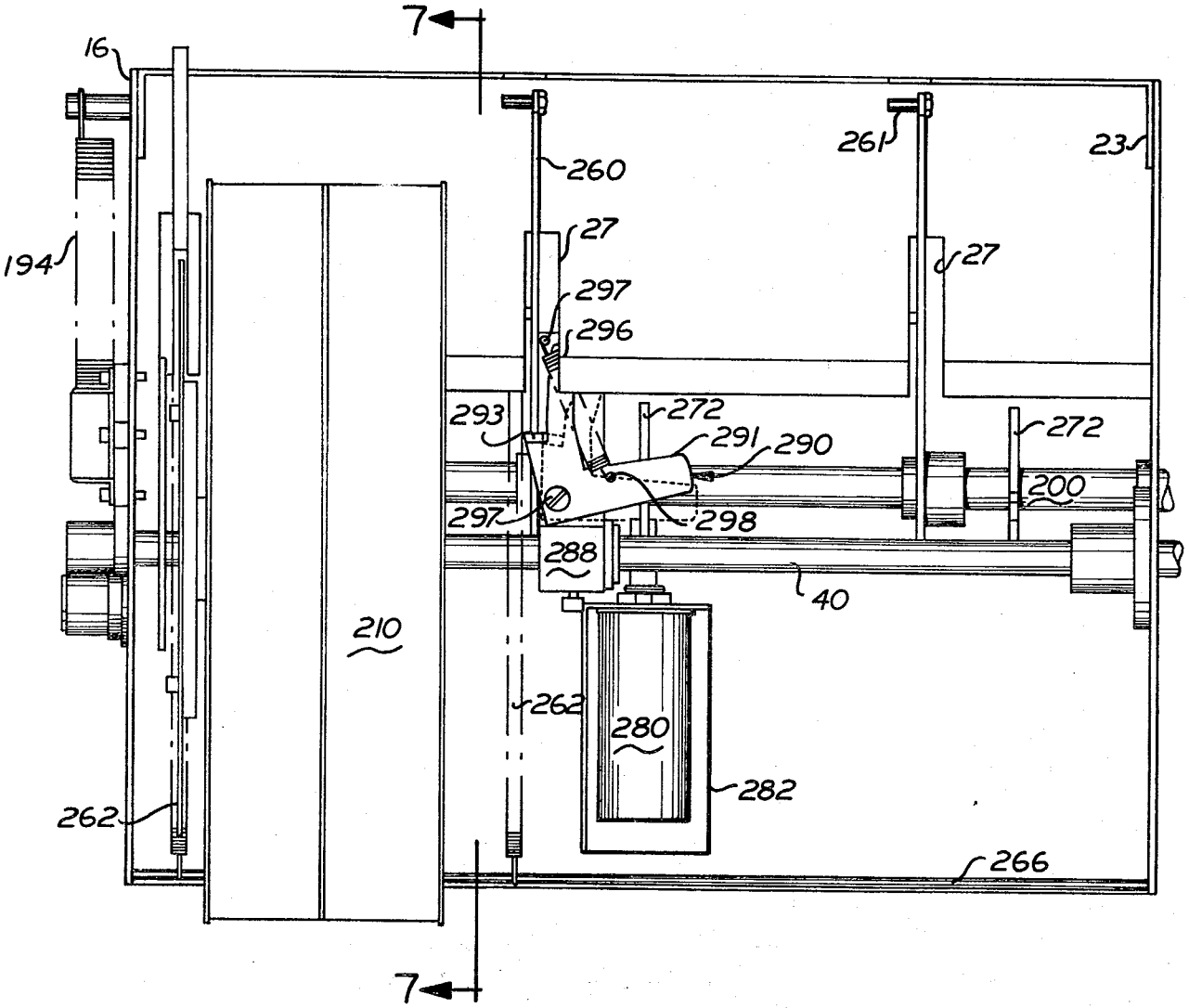
FIG. 8 is a plan view of the device.

As seen in FIGS. 7 and 8 each drum 210 has an annular hub 230 affixed thereto which houses the one-way clutch 212. Each drum also has a toothed latch disc 232 preferably affixed by screws to the drum hub 230 as seen in FIG. 7.

Figure 6:
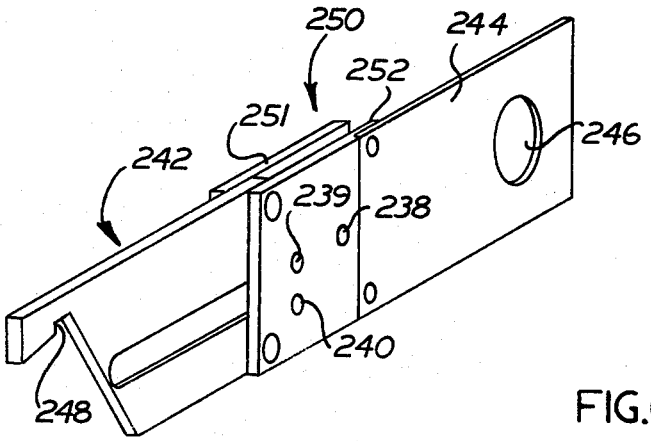
FIG. 6 comprises a perspective view of a photocell mounting bracket.

In order to sense the exact angular position of the latch disc 232, the latch disc is provided with a reference hole 233 and with teeth 236 of configuration as shown in FIG. 7. The hole 233 in the latch disc 232 and characteristic shape of the teeth 236 cooperate with photocells (not shown) mounted at three locations 238, 239, 240 in a bifurcated mounting bracket 242 as best seen in FIGS. 6 and 7. The mounting bracket comprises an elongated plate 244 having a hole 246 in one end thereof which is received on the second shaft 200 and is of a diameter such that the mounting bracket 242 can freely rotate about the second shaft 200. At the other end of the mounting bracket is a hook 248 engageable with the cutouts 29 in the upper edge of the back frame member 22. Precise positioning of the location of the photocell locations 238–240 relative to latch disc 232 is possible without adjustment screws or the like since the bracket 242 is rigidly positioned by shaft 200 and by the depth of cutouts 29.

The mounting bracket has a bifurcated portion 250 comprising of spaced members 251, 252 between which the latch disc teeth 236 rotate. Aligned holes 238, 239, 240 are provided in each of the spaced members 251, 252 for reception of lights and photocells such that a path of light extending from one hole to another aligned holed will be periodically interrupted either by the teeth 236 in the case of holes 239, 240 or, in the case of hole 238, by the latch disc hole 233. The circumferential spacing of two of the holes 239, 240 in the photocell mounting bracket 242 is such that one, but not both, of the holes 239, 240 can be blocked by teeth 236 on the latch disc 232 at the same time. In addition, the teeth on the latch dosc 232 are spaced such that the distance between adjacent teeth 236 is greater than the distance between the two holes 239, 240. Thus, with appropriate electrical control circuitry, the exact rotary position of the latch disc 232 can be accurately ascertained at all times. The latch disc hole 233 is in circumferential alignment with the third hole 238 in the photocell mounting bracket such that a pulse may be produced on the associated photocell once for each complete revolution of the latch disc 232.

The wheel motion arresting mechanism comprises a plurality of index arms 260, one for each wheel or drum 210, freely mounted for pivotal movement about a third shaft 270 which extends between the left and right side plates 16, 18 of the frame. The index arms 260 each are received in a slot 27 provided in the shelf 24 of the frame and have a stop pin 261 affixed to the upper end thereof and engageable with the notches between the teeth 236 in the latch disc 232 as seen in FIG. 7. A tension biasing spring 262 (FIG. 8) is provided for each index arm 260 and has one end affixed to a pin 263 on the index arm 260 and the other end anchored to a transversely extending rod 266 mounted in the frame.

Also mounted for free pivotal rotation on the third shaft 270 are a plurality of actuation levers 272. Each actuation lever 272 has an upwardly extending actuation tongue 274 for a purpose to be described and a vertical notch 276 which receives a transverse pin 277 extending between the bifurcated ends 278 of a solenoid plunger 279. A plurality of solenoids 280 (only one is shown for clarity in FIG. 1) are mounted in brackets 282 affixed to the frame bottom 12 preferably by a pin and slot connection 284 and a securing screw 285. As seen in FIG. 7 each actuation lever has a heel portion 273 engageable with the frame bottom 12 to limit clockwise motion (FIG. 7) of the actuation lever 272 about the third shaft 270 to the solid line position shown in FIG. 7.

Suitable wheel arrest pulses cause withdrawl of the solenoid plungers 279 resulting in counterclockwise movement of the actuation levers 272 such that the tongue 274 of each actuation lever 272 engages one arm 291 of a bell crank 290 (FIG. 8) which will be hereinafter described.

Figure 9:
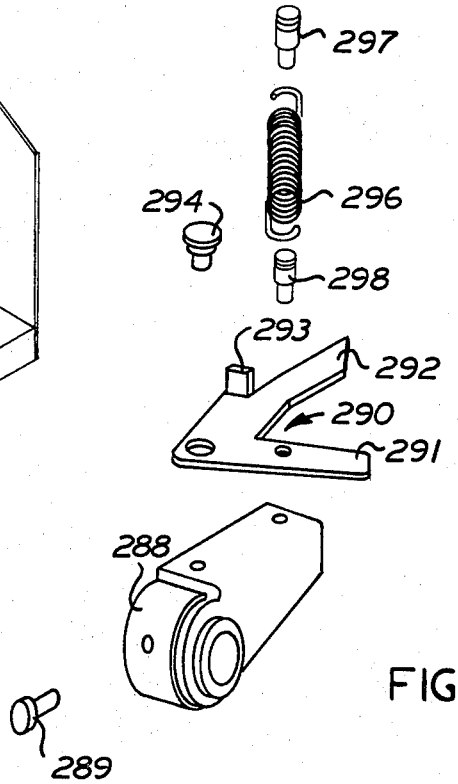
FIG. 9 is an exploded view of the latch assembly parts.

At three spaced locations on the drive shaft are located respective index arm latch assembly brackets 288 as best seen in FIGS. 1, 8, and 9. The latch assembly bracket 288 is nonrotatably affixed to the drive shaft 40 by a fastening screw 289 and has a bracket arm 292 which extends generally toward the associated index arm 260. A pivot screw 294 on the latch assembly bracket 288 mounts bell crank 290 having first and second arms 291, 292 respectively engageable with the actuation tongue 274 on the actuation lever 272 and with the associated index arm 260. An upturned edge 293 on the arm 292 of the bell crank which engages the index arm 260 provides a bearing surface which rides against the forward face of the index arm 260.

A small tension spring 296 extends from anchor pins 297, 298 between the bell crank arm 291 and the remote end of the latch assembly bracket 288 to bias the bell crank 290 in the counterclockwise direction as seen in FIG. 8.

In operation the player deposits a coin in a suitable receptable in the device which actuates an electrical circuit which causes withdrawl of the plunger 74 of the solenoid 72. Withdrawl of the solenoid plunger 74 causes the bell crank 76 to pivot in counterclockwise direction thus removing the clutch latch tongue 82 from the notch 56 in the operating clutch 50. Removal of the latch tongue 82 permits clutch latch release dog 110 to pivot in a clockwise direction under the influence of gravity until the pin 114 in the slot 112 in the release dog 110 limits pivotal movement of the release dog 110 to the dashed line position shown in FIG. 2. The device is now ready to be operated by pulling the usual handle (not shown) which produces a counterclockwise rotating force exerted against the roller 140 thus causing counterclockwise movement of the operating clutch 50. It is here useful to note that limited movement of the operating handle (not shown) and operating clutch 50 within an angle of approximately 10° against the force of the clutch bias spring 60 is permitted to give the user a slight degree of feel even before the coin has permitted the clutch latch tongue 82 to be withdrawn from the latch notch 56.

Continued rotation of the clutch 50 causes the clutch stop ratchet 120 to engage the first tooth 54 on the operating clutch 50 which thus prevents reverse clockwise motion of the clutch 50 under the influence of the clutch bias spring 60. At approximately this same point in time, the clutch trip pawl 160 has rotated with the operating clutch 50 to the point where the trip pawl arm 168 has engaged the drive shoulder 154 on the operating crank 150. Continued rotation of the operating clutch 50 causes rotation of the operating crank 150 and consequent rotation of the drive shaft 40 and latch assembly which is rigidly affixed thereto. In addition, the actuation arm 181 (FIG. 4) has by now engaged the pin 190 on bell crank 192 causing the bell crank 192 to rotate in counterclockwise direction and to thus turn the second shaft 200 inside of the sleeves of one-way clutches 212.

Prior to commencement of rotation of the drive shaft 40, the bell crank 290 on the latch assembly bracket 288 will occupy a position as seen in dashed lines in FIG. 8. The left-hand edge of the bell crank arm 292 is biased by the bell crank spring 296 against the right side of the index arm 260 and the upturned edge 293 of the bell crank arm 292 is disengaged from the front surface of the index arm 260.

Rotation of the drive shaft 40 counterclockwise through an angle of approximately 45° moves the latch assembly bracket 288 sufficiently such that the upturned edge 293 of the bell crank arms 292 passes the front edge of the associated index arm 260 which will be recalled is in a position such that the index arm stop pin 261 is engaged in one of the notches between the teeth 236 in the latch disc 232. As the upturned edge 293 passes the front of the index arm 260, the bell crank biasing spring 296 causes the bell crank 290 to pivot counterclockwise as seen in FIG. 8 from the dashed line position to the solid line position whereby the upturned edge 293 is disposed immediately in front of the associated index arm 260.

Continued rotation of the operating clutch 50, operating crank 150 and shaft 40 counterclockwise as seen in FIG. 2 past the position where the clutch stop ratchet 120 engages the last tooth 54 on the clutch 50 causes the ratchet 120 to drop into the notch 56 on the clutch. The operating clutch 50 is then automatically disconnected from the handle permitting the operating clutch 50 to rotate under the influence of the bias spring 60 (FIG. 2) and drive mechanism including the drive shaft 40 to rotate under the influence of the actuation arm bracket bias spring 182 (FIG. 4) in the clockwise direction (FIG. 2) as the handle is released. This causes an immediate clockwise rotation (FIG. 4) of the impulse bell crank 192 and shaft 200 under the influence of bias spring 194 to impart rotation to the various wheel one-way clutches 212.

Simultaneously during clockwise rotation of the drive shaft as seen in FIG. 1 under the influence of the bias spring 182, the index arm latch assembly is moving in a direction such that the upturned edge 293 of the bell crank arm 292 engages the front of the associated index arm 260 pivoting it about the third shaft 270 to remove the stop pin 261 from the associated notches in the latch disc 232 to permit rotation of the drums 210.

Motion of the respective drums 210 is arrested whenever electrical impulses are caused to actuate the respective solenoids 280. Withdrawl of the solenoid plunger 279 causes the attached actuation lever 272 to move such that the actuation tongue 274 engages the lever arm 291 of the bell crank 290 pivoting the bell crank 290 to the dashed line position shown in FIG. 8 thus moving the upturned latch edge 293 away from the front of the index arm 260. The index arm biasing spring 262 then causes the index arm 260 to rapidly swing forward and engage the pin 261 in one of the latch disc notches immediately arresting rotational movement of the latch disc 232 and attached drum 210 without any appreciable "bouncing" motion found objectionable in prior art devices.

As will be understood to persons skilled in the art, electrical circuitry may be employed with the mechanism disclosed herein to supply drum rotation arrest pulses to the respective solenoids 280 in random sequence such that the final position of the individual drums 210 cannot be predicted.

The switch actuator 218 on the end of the second shaft 200 triggers the switch 220 to provide a pulse each time a wheel rotating impulse is applied to the shaft 200 so that the associated electrical circuitry can detect the lack of simultaneous occurrence of deposit of a coin to actuate the device and the beginning of wheel rotation.

Persons skilled in the art will readily appreciate that various modifications can be made from the preferred embodiment thus the scope of protection is defined only by the limitations of the appended claims.

What I claim is:

1. In an amusement device having a housing, a plurality of rotatable wheels having indicia thereon, means for imparting rotation of said wheels, means for arresting rotation of said wheels, and means for sensing the arrested position of said wheels, the improvement wherein said means for imparting rotation to said wheels comprises:

a substantially horizontal drive shaft;

a clutch rotatable through a drive stroke less than 180° mounted in a substantially vertical plane for free rotation on said drive shaft; a crank drive pawl pivotally mounted on said clutch at a pivot location spaced from the center of rotation of said clutch; and an operating crank non-rotatably affixed to said drive shaft, said operating crank having a drive notch for engagement with said pawl, said clutch being rotatable through a predetermined angle following which said pawl is biased into engagement with said drive notch, said clutch and operating crank thereafter rotating together through a drive portion of the drive stroke.

2. An amusement device according to claim 1 wherein said pawl is gravitationally biased into engagement with said drive notch.

3. An amusement device according to claim 2 wherein said clutch is a circular member having a plurality of teeth on the periphery thereof extending through an angle ranging from 40° to 50°, a latch notch in the periphery of said clutch at one end of the toothed portion, a clutch latch moveable into and out of said latch notch to prvent or permit rotation of said clutch, said latch notch being located in generally horizontal alignment with the axis of rotation of the clutch at the start of the drive stroke, and a latch release dog pivotally mounted on said clutch to gravitationally pivot to a position blocking entry of said clutch latch into said latch notch at the start of the drive stroke.

4. An amusement device according to claim 3 wherein said clutch has a rotation limiting abutment thereon engageable with a stationary stop, a spring biasing said clutch in a direction opposite to the direction of the drive stroke with said abutment in engagement with said stop at the beginning position of the drive stroke.

5. An amusement device according to claim 4 wherein a clutch stop ratchet is engageable with said teeth on said clutch to prevent reverse rotation of said clutch under the influence of said spring after said clutch has rotated through said predetermined angle after which said pawl has become engaged in said drive notch in said operating crank.

6. An amusement device according to claim 5 wherein a second notch is provided in the periphery of said clutch at the other end of said toothed portion, said second notch providing clearance for said ratchet during a limited degree of initial clutch rotation.

7. An amusement device according to claim 1 wherein said clutch is a generally circular member having an annular recess in one face thereof, said operating crank is a generally circular member having a close running fit in said annular recess, and a cutout is provided in the periphery of said clutch in axial alignment with said operating crank, said cutout being generally radially aligned with said drive notch in said operating crank when said pawl is engaged in said drive notch, said pawl having a surface engageable with the annular periphery of said operating crank when said pawl is not engaged in said drive notch.

8. An amusement device according to claim 7 wherein said drive shaft has an actuation arm affixed thereto, a bell crank pivotally mounted on said housing, said actuation arm being engageable during the drive portion of the drive stroke with said bell crank to rotate said bell crank in a first direction against action of a bias spring, said bias spring at the completion of the drive stroke causing rotation of said bell crank in a second direction to impart rotation to said rotatable wheels.

9. An amusement device according to claim 8 wherein said pawl is gravitationally biased into engagement with said drive notch.

10. In an amusement device having a housing, a plurality of rotatable wheels having indicia thereon, means for imparting rotation to said wheels, means for arresting rotation of said wheels, and means for sensing the arrested portion of said wheels, the improvement wherein the means for arresting rotation of said wheels comprises:

a substantially horizontal drive shaft mounted in said housing;

a substantially horizontal support shaft mounted in said housing parallel with said drive shaft;

a plurality of index arms freely mounted for pivotal movement on said support shaft, one index arm for each wheel, said index arms each having stop means thereon for arresting rotation of an associated wheel;

springs for biasing said index arms toward said wheels, each wheel having a latch disc rigidly affixed thereto, said wheels and latch discs being rotatable in parallel planes on a common shaft, said latch discs having notches thereon engageable by said stop means on said index arms; a plurality of actuation levers freely rotatable on said support shaft;

a plurality of solenoids each having a moveable member engageable with a respective actuation lever; and a plurality of index arm latch assemblies rigidly affixed to said drive shaft and rotatable therewith, for moving said index arms out of engagement with said notches in said latch discs and holding said index arms in said non-engaged positions, said latch assemblies being engageable by said actuation levers for releasing said index arms upon actuation of said solenoids.

11. An amusement device according to claim 10 wherein each latch assembly comprises:

an elongated bracket affixed at one end to said drive shaft;

a bell crank pivotally mounted on said bracket, said bell crank having a first arm engageable with said actuation lever and a second arm for engagement with said index arm;

and a spring connecting said first arm of said bell crank to said bracket to bias said second arm into engagement with said index arm.

12. An amusement device according to claim 11 wherein said second arm of said bell crank has a generally vertically extending surface thereon moveable into and out of a generally vertical plane, said associated index arm being moveable in said plane.

13. An amusement device according to claim 11 wherein said means for imparting rotation of said wheels comprises:

a clutch rotatable through a drive stroke less than 180° mounted in a substantially vertical plane for free rotation on said drive shaft; a crank drive pawl pivotally mounted on said clutch at a pivot location spaced from the center of rotation of said clutch; and an operating crank non-rotatably affixed to said drive shaft, said operating crank having a drive notch for engagement with said pawl, said clutch being rotatable through a predetermined angle following which said pawl is biased into engagement with said drive notch, said clutch and operating crank thereafter rotating together through a drive portion of the drive stroke.

14. An amusement device according to claim 10 wherein the means for sensing the position of said wheels comprises, for each wheel, radiation source means and photocell means aligned with said source means and with said notches on said latch discs for electrically counting the number of notches passing said photocell means during wheel rotation.

15. An amusement device according to claim 14 wherein said photocell means and said radiation source means are mounted in a bifurcated bracket supported at one end by said common shaft and at its other end by the housing.

* * * * *